US007540652B2

(12) United States Patent
Krzywdziak et al.

(10) Patent No.: US 7,540,652 B2
(45) Date of Patent: Jun. 2, 2009

(54) PAINT CAN COVER ASSEMBLY WITH IMPROVED LOCKING MEANS

(75) Inventors: Alain Krzywdziak, Orleans (FR); Raymond Cosson, Baule (FR); Brent Mussatto, Commerce Township, MI (US)

(73) Assignee: Dedoes Industries, Inc., Walled Lake, MI (US)

( * ) Notice: Subject to any disclaimer, the term of this patent is extended or adjusted under 35 U.S.C. 154(b) by 1222 days.

(21) Appl. No.: 10/651,270

(22) Filed: Aug. 28, 2003

(65) Prior Publication Data

US 2005/0045665 A1 Mar. 3, 2005

(51) Int. Cl.
*B01F 7/20* (2006.01)
*B65D 41/16* (2006.01)

(52) U.S. Cl. ..... 366/247; 220/780; 222/472; 222/570

(58) Field of Classification Search ..... 222/470, 222/472, 473, 474, 567, 570; 366/247, 347, 366/605; 220/324, 326, 784, 788
See application file for complete search history.

(56) References Cited

U.S. PATENT DOCUMENTS 1,811,080 A * 6/1931 Gadke ..... 222/556
1,845,966 A * 2/1932 Flautt ..... 222/567
3,041,052 A * 6/1962 Dedoes ..... 366/247
3,688,942 A * 9/1972 Mitchell et al. ..... 220/784
5,622,289 A * 4/1997 Dedoes ..... 222/472
6,336,740 B1 1/2002 Keough ..... 366/247
2002/0088811 A1 * 7/2002 Lu ..... 220/780
2002/0145939 A1 * 10/2002 Keough ..... 366/247

* cited by examiner

*Primary Examiner*—Kevin P Shaver
(74) *Attorney, Agent, or Firm*—Gifford, Krass, Sprinkle, Anderson & Citkowski, P.C.

(57) ABSTRACT

A cover assembly for a paint can having a tubular cylindrical sidewall, an open top and an outwardly protruding rim around the open top and in which the rim has a downwardly facing angular surface. The cover assembly includes a lid dimensioned to overlie the open top of the paint can. The lid includes a spout for pouring paint from the paint can. At least two spaced apart resilient locking tabs are attached to the paint can which automatically engage the downwardly facing annular surface of the rim as the lid is positioned onto the top of the paint can thereby locking the lid to the paint can. A release lever attached to each locking tab enables the lid to be removed from the paint can when desired.

18 Claims, 3 Drawing Sheets

PAINT CAN COVER ASSEMBLY WITH IMPROVED LOCKING MEANS

BACKGROUND OF THE INVENTION

I. Field of the Invention

The present invention relates generally to cover assemblies for paint cans and, more particularly, to such a cover assembly with improved means for locking the cover assembly to the paint can.

II. Description of Related Art

There are a number of previously known cover assemblies for paint cans which are designed to overlie the open top of the paint can. Such cover assemblies include a spout and a cooperating closure which selectively opens and closes the spout. When the spout is open, paint can be poured from the can.

Many of these previously known cover assemblies are designed for use with automatic paint stirring equipment. As such, they include a stirring assembly rotatably mounted to the cover assembly such that a stirrer is positioned within the can. A drive member extends upwardly from the paint cover which cooperates with a drive member in a rack of the automatic paint stirring equipment in order to continuously stir the paint. Such automatic paint stirring equipment is typically used in automotive body repair shops and the like.

In order to secure the cover assembly to the top of the paint can, typically two or more locking feet are attached to the paint can lid. These locking feet are spring-loaded and are rotatable between a locked and an unlocked position. In their locked position, the locking feet extend under the paint can chime so that a portion of the paint can chime is compressibly sandwiched between the lid and the locking feet.

One disadvantage of these previously known paint can cover assemblies is that the locking feet used to secure the cover assembly to the paint can are relatively expensive to manufacture and assemble. As such, these previously known locking feet increase the overall cost of the cover assembly.

A still further disadvantage of these previously known locking feet is that, as the locking foot is rotated between its unlocked and locked positions, the locking feet oftentimes scrape against the chime. In doing so, the protective cover on the paint can chime can be damaged thus exposing the raw metal of the paint can to the contents of the paint can. This raw metal is subject to rust or other deterioration which can ruin the paint within the paint can.

A still further disadvantage of the previously known paint can covers which utilize locking feet to secure the cover assembly to the paint can is that the locking feet are exposed to and become covered with the paint from the paint can during use. This, in turn, can result in accumulation of dried paint around the locking feet. Such dried paint, however, is difficult to adequately clean from the locking feet. When this occurs, the entire paint can cover assembly is oftentimes discarded.

SUMMARY OF THE PRESENT INVENTION

The present invention provides a cover assembly for a paint can which overcomes all of the above-mentioned disadvantages of the previously known devices.

In brief, the cover assembly of the present invention is designed for use with a paint can having a tubular cylindrical sidewall, an open top and an outwardly protruding rim around the open top. The rim also includes a downwardly facing annular surface.

The cover assembly comprises a lid which is dimensioned to overlie the open top of the paint can. This lid has a spout and a handle is attached to the lid to facilitate pouring of paint from the paint can through the spout. Additionally, a closure assembly is mounted on the lid in order to selectively open and close the spout.

In order to detachably secure the paint can cover across the open top of the paint can, the cover assembly of the present invention includes at least two, and preferably three or more, resilient locking tabs which are spaced apart from each other and extend downwardly around the outer periphery of the paint can lid. These locking tabs include a ramp surface which engages the rim as the lid is positioned over the top of the paint can so that the coaction from the rim and the ramp surface flexes the locking tabs outwardly as the lid is positioned over the open top of the paint can. As the lid is fully positioned over the open top of the paint can, the locking tabs flex radially inwardly so that an abutment surface formed on each locking tab engages the downwardly facing annular surface of the paint can rim thereby locking the cover assembly to the paint can.

A release lever is also attached to each locking tab so that the release lever protrudes upwardly above an upper surface of the paint can lid. When it is desired to remove the cover assembly from the paint can lid, the release levers are flexed radially outwardly thus disengaging the abutment surface on the locking tabs from the paint can rim and enabling the cover assembly to be removed from the paint can.

Preferably, the paint can lid and locking levers are of a one-piece plastic construction.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
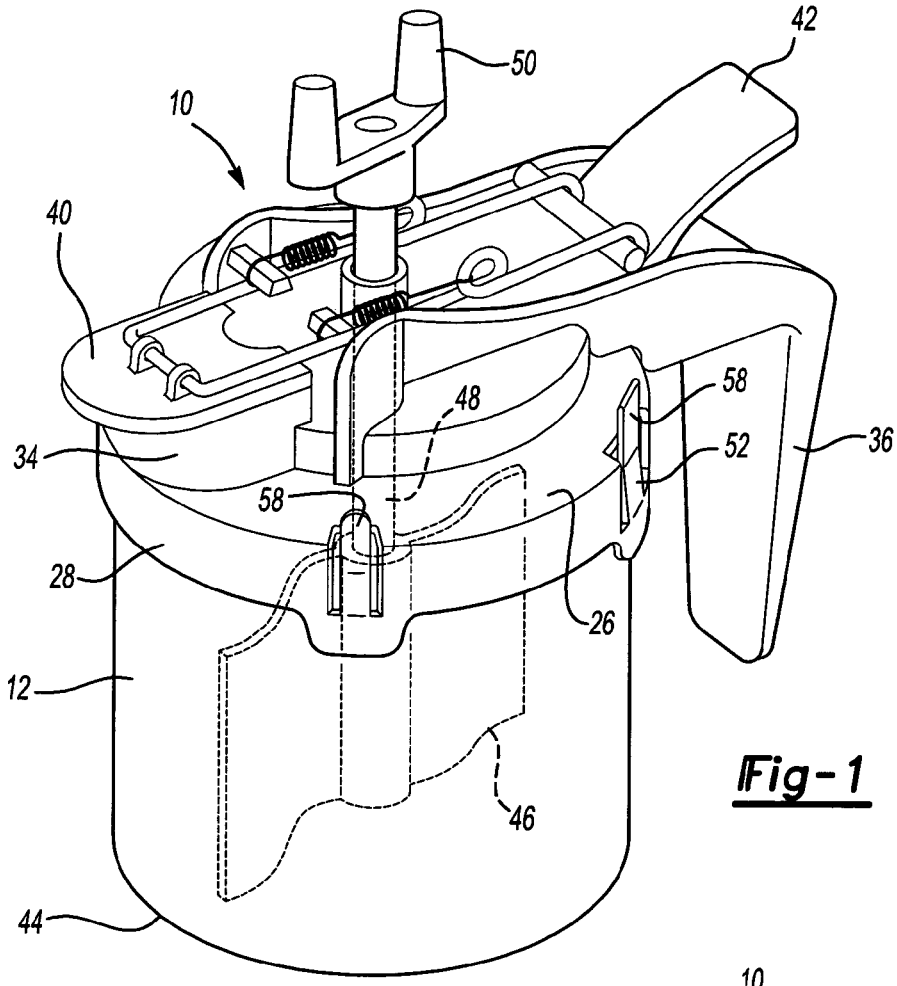
FIG. 1 is an elevational view illustrating a preferred embodiment of the present invention.
Figure 2:
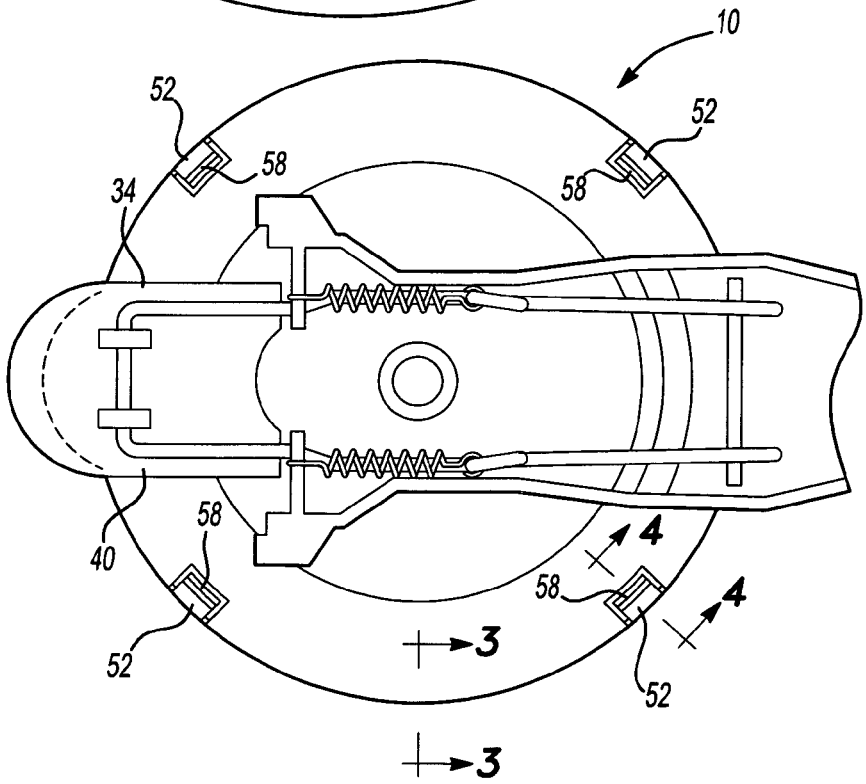
FIG. 2 is a top plan view illustrating the preferred embodiment of the present invention.
Figure 3:
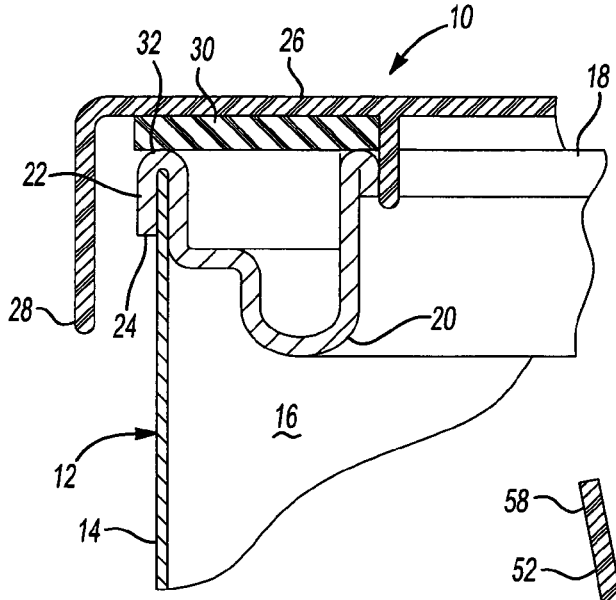
FIG. 3 is a sectional view taken substantially along line 3-3 in FIG. 2 and enlarged for clarity.

With reference first to FIGS. 1-3, a preferred embodiment of the paint can cover assembly 10 is illustrated for use in conjunction with a paint can 12. The paint can 12 includes a tubular and cylindrical sidewall 14 (FIG. 3) which defines an interior chamber 16 in which paint is contained.

As best shown in FIG. 3, the paint can 12 also includes an open top 18 formed around the inner periphery of a paint can chime 20. The paint can chime, in the conventional fashion, is attached to the tubular cylindrical sidewall 14 by a rim 22. This rim 22, furthermore, includes a downwardly facing annular surface 24 which extends around the entire outer periphery of the paint can sidewall 14 adjacent its open top 18.

Still referring to FIGS. 1-3, the paint can cover assembly 10 of the present invention comprises a generally circular lid 26 having an outer and downwardly depending annular skirt 28 around its outer periphery. The paint can lid 26 with its attached skirt 28 is dimensioned to overlie and cover the open top 18 of the paint can 12 so that the annular skirt 28 overlies both the rim 22 as well as the upper portion of the paint can sidewall 14. Preferably, the lid 26 and skirt 28 are of a one-piece plastic construction.

It will be understood, however, that the skirt 28 need not extend entirely around the outer periphery of the lid 26 but, rather, may only extend segments around the lid 26 and, indeed may be altogether eliminated.

As best shown in FIG. 3, a resilient seal 30 is attached to the lid 26. This seal 30 compresses against an upwardly facing surface 32 of the paint can rim 22 when the paint can cover assembly 10 is positioned onto the top of the paint can 12 and into its operative position.

With reference now to FIGS. 1 and 2, in the conventional fashion, the paint can lid 26 includes a pouring spout 34 for dispensing paint from the paint can 12. A handle 36 is preferably mounted to the lid 26. The handle 36 is diametrically opposed from the spout and is preferably of a one-piece plastic construction with the lid 26.

Still referring to FIGS. 1 and 2, a closure 40 is movably mounted to the lid 26 and movable between a closed position, illustrated in FIG. 1, and an open position, illustrated in phantom line in FIG. 2. In its closed position, the closure 40 covers the spout 34. Conversely, in its open position, the closure uncovers at least a portion of the spout 34 to enable paint to be dispensed from the paint can 12. A lever 42 (FIG. 1) is attached to the closure 40 to move the lid between its open and closed positions.

The cover assembly 10 preferably includes a stirring assembly 44 having a stirrer 46 mounted within the interior 16 of the paint can 12. The stirrer 46 is rotatably mounted to the paint can lid 26 by a shaft 48 while a drive member 50 is secured to the shaft 48 above the paint can lid 26. The driver member 50 illustrated in FIG. 1 is of the type used with automatic paint stirring equipment. Conversely, however, a crank handle may be attached to the lid 48 to manually stir the contents of the paint can 12.

Figure 4:
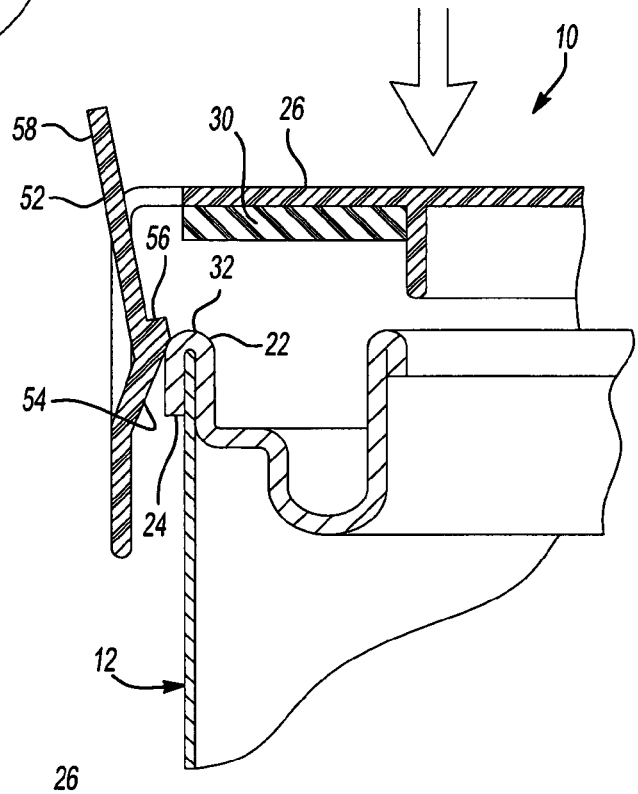
FIG. 4 is a sectional view taken substantially along line 4-4 in FIG. 2 and enlarged for clarity.

With reference now to FIGS. 2 and 4, in order to detachably secure the cover assembly 10 the paint can 12, the cover assembly 10 includes at least two, and preferably three or four, resilient locking tabs 52. These locking tabs 52 are preferably integrally formed with the annular skirt 28 and, as best shown in FIG. 2, are spaced apart from each other and are preferably circumferentially spaced equidistantly from each other.

Figure 5:
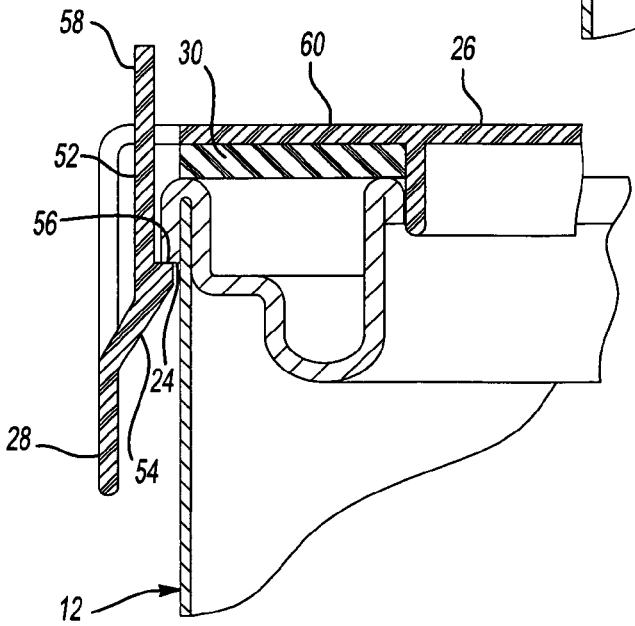
FIG. 5 is a diagrammatic view, similar to FIG. 4, but illustrating the paint can cover assembly in a partially inserted position over the paint can.

With reference now to FIGS. 4 and 5, each locking tab 52 includes a ramp surface 54 which engages the rim 22 as the lid 26 is positioned on top of the paint can 12. Consequently, as best shown in FIG. 5, as the paint can lid 26 is positioned on top of the paint can 12, the coaction between the ramp surface 54 and the rim 22 causes the locking tabs 52 to flex outwardly as shown in FIG. 5 as the lid is pressed onto the top of the can 12.

Each locking tab 52 further includes an upwardly facing and generally planar abutment surface 56 immediately above the ramp surface 54. When the paint can lid 26 is fully positioned on top of the paint can 12 and in its operative position, this abutment surface 56 is positioned below the downwardly facing surface 24 of the rim 22. Consequently, when the lid 26 is positioned in its locked position as shown in FIG. 4, the resiliency of the locking tabs 52 causes the locking tabs 52 to flex inwardly such that the locking tab abutment surface 56 is positioned below and in engagement with the downwardly facing surface 24 of the rim 22 thus locking the cover assembly 10 to the paint can 12. Simultaneously, as shown in FIG. 4, the seal 30 is compressed against the upper surface 32 of the rim thus sealing the lid 26 to the paint can 12.

Figure 6:
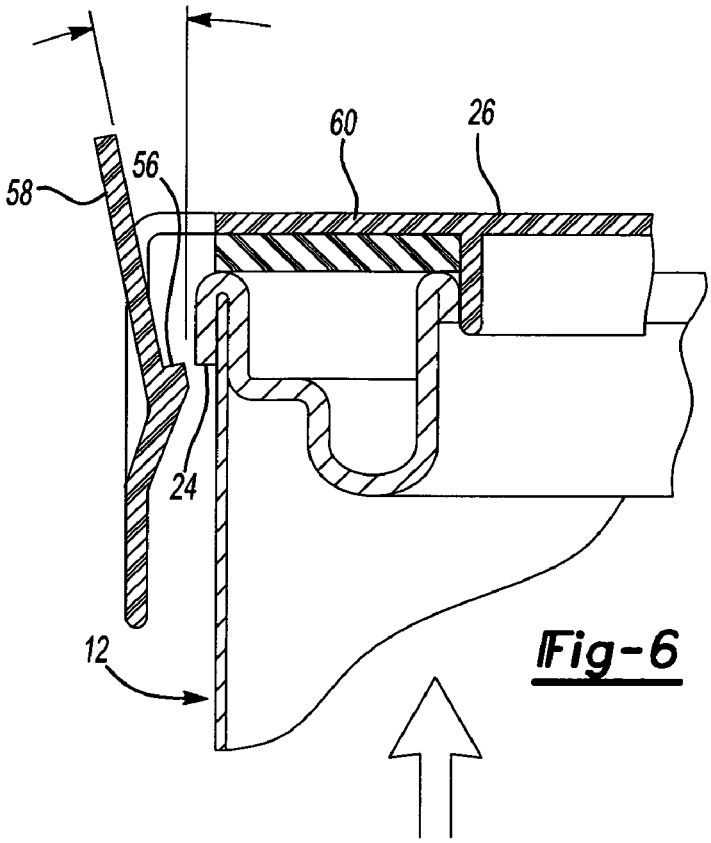
FIG. 6 is a view similar to FIG. 4, but illustrating the cover assembly in a removed position from the paint can.
Figure 7:
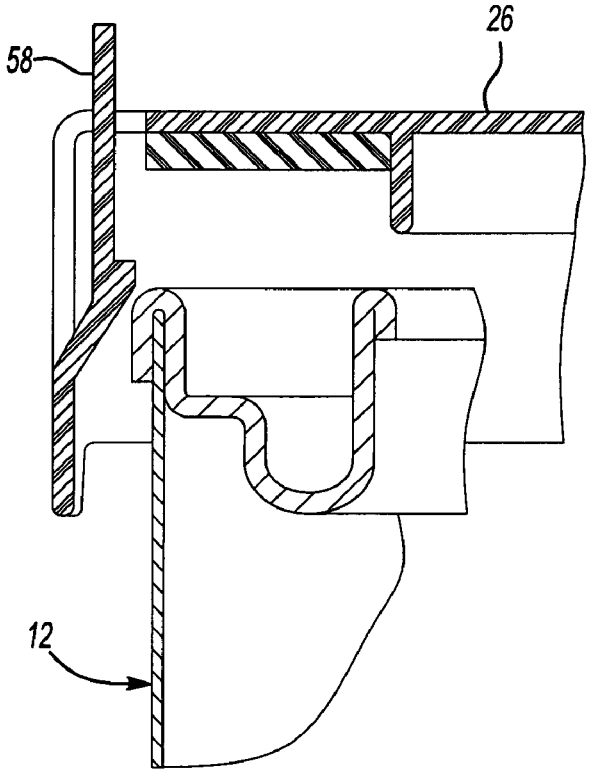
FIG. 7 is a view similar to FIG. 6, but illustrating the removal of the lid from the can.

With reference now to FIGS. 6 and 7, in order to detach the cover assembly 10 from the paint can 12 when desired, each locking tab 52 includes a release lever 58 which protrudes above an upper surface 60 of the lid 26. Thus, when it is desired to remove the cover assembly 10 from the paint can 12, the release levers 58 are manually deflected radially outwardly, as shown in FIG. 6, thereby disengaging the locking tabs' surfaces 56 from the downwardly facing paint can rim surface 24. In doing so, the paint can lid 26 can be removed from the paint can 12 as shown in FIG. 7.

Preferably, the locking tabs 52 together with their release levers 58 are of a one-piece construction with the annular skirt 28. Furthermore, although the locking tabs 52 are preferably integrally formed with the annular skirt 28, it will be understood that the annular skirt is optional. In the event that the annular skirt is removed, the locking tabs are attached to and extend downwardly directly from the lid 26.

From the foregoing, it can be seen that the present invention provides a novel, simple, inexpensive and yet totally effective paint can cover which overcomes all of the above-mentioned disadvantages of the previously known devices. Having described our invention, however, many modifications thereto will become apparent to those skilled in the art to which it pertains without deviation from the spirit of the invention as defined by the scope of the appended claims.

We claim:

1. A cover assembly for a paint can having a tubular cylindrical sidewall, an open top and an outwardly protruding rim around the open top, the rim having a downwardly facing annular surface, said cover assembly comprising:

a lid dimensioned to overlie the open top of the paint can, said lid having a spout, means for attaching said lid to the paint can, said attaching means comprising at least two spaced apart resilient locking tabs which automatically engage the downwardly facing annular surface of the rim as said lid is positioned onto said top of the paint can.

2. The invention as defined in claim 1 wherein said attaching means comprises at least three spaced apart resilient locking tabs.

3. The invention as defined in claim 2 wherein said locking tabs are circumferentially equidistantly spaced apart from each other.

4. The invention as defined in claim 1 wherein said attaching means comprises at least four spaced apart resilient locking tabs.

5. The invention as defined in claim 1 and comprising an annular skirt which is secured to and depends downwardly from said lid, said annular skirt overlying at least a portion of the paint can sidewall when said lid is positioned on the top of the paint can.

6. The invention as defined in claim 5 wherein said locking tabs are of a one-piece construction with said annular skirt.

7. The invention as defined in claim 6 wherein said lid and said annular skirt are of a one-piece construction.

8. The invention as defined in claim 7 wherein said lid, said annular skirt and said locking tabs are made of plastic.

9. The invention as defined in claim 1 wherein each locking tab includes a substantially planar abutment surface which engages the downwardly facing annular surface of the rim when said lid is positioned on top of the paint can.

10. The invention as defined in claim 9 wherein each said locking tab includes a ramp surface which engages an upper surface of the paint can rim as said lid is positioned on top of the paint can, said ramp surfaces deflecting said locking tabs outwardly upon insertion of said lid onto the top of the paint can.

11. The invention as defined in claim 9 wherein each locking tab includes a release lever which protrudes upwardly above an upper surface of said lid.

12. The invention as defined in claim 11 wherein said locking tab and said release lever are of a one-piece construction.

13. The invention as defined in claim 1 and comprising a paint stirring assembly rotatably mounted to said lid.

14. The invention as defined in claim 1 and comprising a handle attached to said lid.

15. The invention as defined in claim 14 wherein said handle and said lid are of a one-piece construction.

16. The invention as defined in claim 1 and comprising a closure movably mounted to said lid between a first position in which said closure covers said spout and a second position in which said closure uncovers at least a portion of said spout.

17. The invention as defined in claim 16 and comprising a lever attached to said closure for selectively moving said closure between said first and second positions.

18. The invention as defined in claim 1 and comprising a seal mounted to said lid, said seal being dimensioned to abut against an upper surface of the paint can rim as said lid is positioned on top of the paint can.

* * * * *